United States Patent [19]

Safford

[11] 3,932,238

[45] Jan. 13, 1976

[54] METHOD AND APPARATUS FOR QUENCHING PIPE

[75] Inventor: Franklin C. Safford, Philadelphia, Pa.

[73] Assignee: Drever Company, Huntingdon Valley, Pa.

[22] Filed: Jan. 24, 1975

[21] Appl. No.: 543,778

[52] U.S. Cl. ..... 148/131; 148/153; 266/4 S; 266/6 PC; 266/6 S

[51] Int. Cl.[2] ..... C21D 1/62

[58] Field of Search ..... 148/131, 153; 266/4 S, 266/6 PC, 6 S

[56] References Cited

UNITED STATES PATENTS

| | | | |
|---|---|---|---|
| 3,749,384 | 7/1973 | Werner | 148/131 |
| 3,804,390 | 4/1974 | Jennings et al. | 148/153 |

*Primary Examiner*—W. Stallard

*Attorney, Agent, or Firm*—Buell, Blenko & Ziesenheim

[57] ABSTRACT

A pipe is heated with its longitudinal axis positioned vertically and then lowered from a furnace. As the pipe emerges from the furnace, it engages an inner ring of rollers and an outer ring of rollers which press against the hot pipe to shape it into a round configuration and to restrain the pipe during the initial impingement of quench fluid. As the pipe continues downward it is quenched by impinging the inside and outside surfaces with converging cones of high intensity quench liquid forming impingement rings on the inner and outer surfaces of the pipe which are opposite. The cooling by application of additional fluid and restraint by rings of rollers are continued after passage through the high intensity zone until the pipe reaches ambient temperature.

12 Claims, 12 Drawing Figures

METHOD AND APPARATUS FOR QUENCHING PIPE

This invention relates to a method and apparatus to quench harden pipe to provide it with selected properties.

PROBLEM PRESENTED TO THE INVENTOR

A demand for high strength large diameter thin-walled steel pipe by the petroleum industry is anticipated by pipe producers. It is believed that considerable quantities of high strength large diameter thin-walled steel pipe will be produced to meet API (American Petroleum Institute) specification 5LU (May 1972) for "Ultra High-Test Heat Treated Line Pipe" which requires that welded pipe shall be heat treated after welding. These specifications covered pipe outside diameters from 6⅝ to 48 inches and wall thickness from 0.083 to 1 inch inclusive; lengths are required to be 17 ft. 6 in. or 35 ft. minimum, as specified, and have been produced as long as 60 ft. Most large diameter pipe is fabricated by "U"-ing and "O"-ing presses forming plate into cylindrical shape which is followed by welding of the longitudinal seam. Alternatively, the pipe is spirally formed from plate and the spiral seam is welded. In either case the weld seam has "overfill" (or weld beads) that project above the balance of the pipe surface. Overfill of the outside weld bead is specified as not to exceed ⅛ inch for up to and including ½ inch wall thickness or 3/16 inch for over ½ inch wall thickness. Without further shaping, the roundness of the pipe (before heat treatment) does not conform to the desired finished product.

Apparatus intended for heat treatment of such pipe must be capable of accomplishing a combination of results including:

a. the development of uniformity of the high mechanical strength and impact resistance properties required;
b. the ability to handle the pipe with its weld bead projections and its out-of-roundness;
c. the ability to heat the pipe to the quenching temperature without producing more out-of-roundness than already present in the untreated pipe;
d. the ability to remove out-of-roundness of the hot pipe as it exits the heating furnace;
e. the ability to quench the pipe uniformly and to restrain it as necessary to prevent it from going out-of-round during the quench; and
f. the pipe must be effectively quenched both externally and internally to permit the use of the lowest possible amount of hardening elements in the steel composition for the thickness of the section involved.

It must be understood that good roundness of the heat treated pipe is required so that the ends of the pipes can be properly fitted to each other for field welding of the lengths of pipe to produce a pipeline. It is also important to use a steel with the minimum amount of hardening elements not only to achieve the lowest cost but most importantly the lower hardenability steels can be most easily welded under field conditions without the development of cracks or other weld defects.

Commercial equipment has been constructed to quench harden pipe by progressive external induction heating of a short segment of the pipe followed by the sequential application of quench fluid to only the outside surface. The shape of the hot pipe is maintained by the constraint of the cold segments adjacent to the heated segments. This technique has severe practical limitations. Applying quench fluid only to the outside diameter makes it necessary to add hardening elements adequate for twice the wall thickness being processed as compared to those required for pipe that is quenched both internally and externally. Furthermore, the speed with which the pipe can be passed through the quench under such a technique is limited to the rate of heating of the narrow segment under the induction coil which in turn limits rate of production of pipe. Obviously heating entire lengths of pipe at one time in a furnace will permit a much faster production rate than induction heating of short ring segments.

A further disadvantage of segmental induction heating is that both the leading and trailing ends of a pipe so treated must be cut off and discarded because they will be ineffectively hardened.

THE PRIOR ART

U.S. Pat. No. 3,294,599 issued Dec. 27, 1966 to Robert A. Huseby teaches a method and apparatus for quench hardening a pipe. Huseby shows heating a pipe horizontally in a furnace and moving it through a continuous stream of quenching media applied both externally and internally. The pipe is simultaneously rotated in an attempt to prevent it from going out-of-round while it is in the heated condition. The quench fluid is projected in the form of rod-like streams against the surface of the pipe at a slight angle away from the unquenched portion of the pipe which is claimed to prevent premature cooling of the unquenched portion of the hot pipe which would otherwise be caused by splashing action of the quenching media.

Huseby's technique, however, has major disadvantages that make it impractical for quenching long thin-walled pipe. In the horizontal position gravity tends to cause the hot pipe to lose its round configuration and go into distorted oval shapes before the application of quenching fluid. Rotating the pipe to compensate for this is ineffective. While it might be possible to rotate a hot thin-walled, large diameter pipe at a speed which would not allow time for plastic flow to occur, it is obvious that a speed of rotation sufficient to generate centrifugal forces that will balance and so greatly exceed gravity that the "out-of-round" would be insignificant, is impractical. Furthermore, quench fluid delivered to the inside of the pipe in the horizontal position flows to the bottom of the pipe and accumulates there which makes uniform cooling impossible. Application of the quench fluid in the form of rod-like streams will not produce a uniform quench in steels having small amounts of hardening elements but will do so only in steels having high hardenability.

Huseby acknowledged the use of earlier vertical quenches which quenched both the inside and the outside of the pipe while moving the pipe in a vertical direction. Huseby discarded the vertical quench and found that because of "practical limitations" such devices were used only for surface hardening of items such as casing pipe. Huseby also states that it was necessary to first dispose the inner quench head completely within the pipe before commencing either the heating or quenching operation which is impractical for anything except induction heating. Apparently, for these reasons Huseby abandoned the vertical concept and went to his horizontal concept.

U.S. Pat. No. 2,556,236, issued June 12, 1951 to Harold A. Strickland, teaches a method of treating a tube or cylindrical bushing of high carbon quench hardenable steel by the induction heating of layers of inner and outer surface material followed by quenching. This produces a greater depth of hardness on the outside surface than on the inner surface by a ratio of about four to three which results in a combination of locked-in stresses which will be equal and opposite and thus will not tend to distort the tube. The method requires restricting the hardening to only surface layers of the high carbon, quench hardenable material. This method is completely unsuited to quench hardening of large diameter, thin-walled line pipe:

i. made of steel with the lowest possible hardening elements; or ii. formed by shaping and welding.

Uniform heating would not be accomplished because of the heavier sections where the required welding technique leaves overfill. No effective hardening of a lean steel could be accomplished because the very slow movement of the heating coils relative to the tube would allow ample time for cold portions of the tube to pre-cool adjacent heated portions below the critical temperature thus making hardening impossible. For these reasons the method described by Strickland is suitable only for seamless tubing of high carbon easily quench hardenable steels.

As to the apparatus shown and described, the "holding rings" could only accurately position a short length of heavy walled tube. The holding rings would be completely ineffective in shaping or restraining, during quenching, a large, relatively thin-walled long section of pipe.

U.S. Pat. No. 2,295,272, issued Sept. 8, 1942 to Howard E. Somes, also teaches a method for differentially hardening inner and outer surfaces of a tube to result in combinations of stresses. Like Strickland, and for the same reasons, this method is equally unsuited to the quench hardening of pipe made of steel having the lowest possible hardening elements or of pipe formed by shaping and welding. Additionally, Somes neither describes nor shows any means for shaping or restraining a pipe.

U.S. Pat. No. 3,420,083, issued Jan. 7, 1969 to me and others. The equipment and method are for quench hardening a heated metal plate. It might be considered that the vertical pipe quench described is essentially the "Roller Pressure High Intensity Quench System" of this prior art, with the quench fluid delivery method and restraining rollers modified to conform to circular pipe instead of to plate or strip. However, such is not the case for the following reasons:

1. The circular pipe delivered to the heating furnace and exiting the heating furnace is not truly round, but it is essential that it be shaped to an accurate round before the pipe is moved into the quench streams, otherwise uniformity of quench fluid application could not be attained.

2. Plate in the prior art may or may not be flat as delivered to the heating furnace but during heating, the plate tends to assume a flat configuration since it becomes plastic and sags when near or at the quenching temperature to conform to the flat environment present in the plate heating furnace.

3. If warped plate is produced by any of the existing prior art plate quenching systems, the plate can be readily flattened by conventional roller leveler equipment. Conversely, there is no mechanical equipment in existence or feasible for rounding and straightening warped line pipe of typical thin-wall, large-diameter, long length pipes. The only known method of improving roundness of such warped pipe is by hydraulic expansion which causes a permanent increase of both internal and external diameter and the extent to which this remedy is permitted by A.P.I. Specification is limited to 0.5% of the pipe diameter.

THE INVENTION

Franklin Safford's solution overcomes the problems inherent in both the previous horizontal and vertical quenching concepts. Safford uses a vertical technique and supports the hot pipe by an elevator means and continuously lowers it into a pair of rings of corresponding and opposed internal and external rollers that press against the hot pipe for three purposes, namely:

1. to shape the pipe to the accurate roundness that is necessary in the final product;
2. to insure the uniform application of quenching fluid; and
3. to maintain the pipe in a round configuration.

The pipe moves continuously and is lowered vertically from between the initial rollers into a high intensity quench zone which applies quench fluid on the inside surface and outside surface of the pipe forming opposite rings of impingement on the surfaces of the pipe. As the pipe is lowered the quenching is continued by the application of additional quench fluid of a lower intensity than that of the initial impingement. This technique quenches the pipe with the highest possible effectiveness, avoids non-uniformity of the quench and produces the round configuration of the pipe prior to and during the quenching. It allows the use of the lowest possible hardening elements which not only minimizes steel cost but is very important for the quality of the field welds used to connect lengths of pipe.

The means for moving the pipe can be either above or below the furnace and the pipe supported by attachment at the top of the pipe or support of the bottom or both. The present embodiment is shown in the drawings which show supporting the pipe from the bottom.

I provide an apparatus for vertically quenching a hot metal pipe comprising a first means shaping the hot pipe into a round configuration and restraining the pipe in the round configuration; a second means applying high intensity curtains of quench fluid to the inside surface of the pipe and to the outside surface of the pipe, the quench curtains impinge the inner and outer surfaces in the form of rings; and a third means supporting the pipe and continuously moving it to and through the first means then through the second means in a substantially vertical path in the direction of the longitudinal axis of the pipe.

DESCRIPTION OF THE METHOD AND APPARATUS OF THE INVENTION

A. The Structure

Figure 1A:
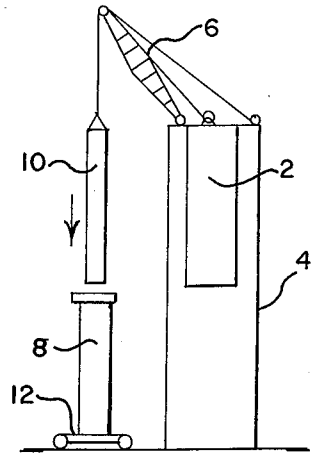
FIGS. 1A–1F are schematics showing the sequence of operations.
Figure 1B:
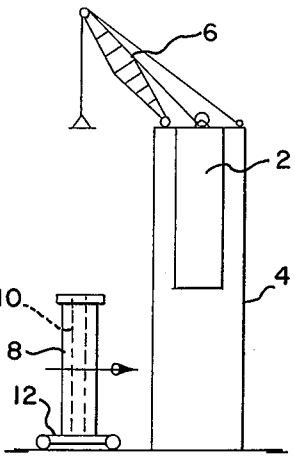
Figure 1C:
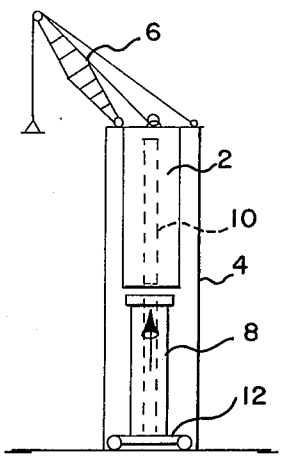
Figure 1D:
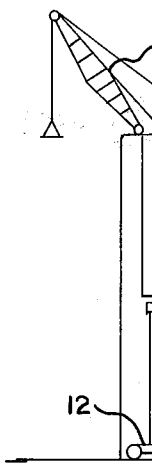
Figure 1E:
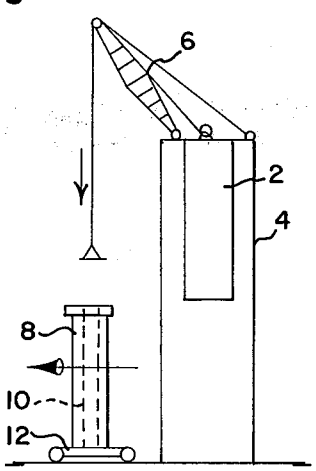
Figure 1F:
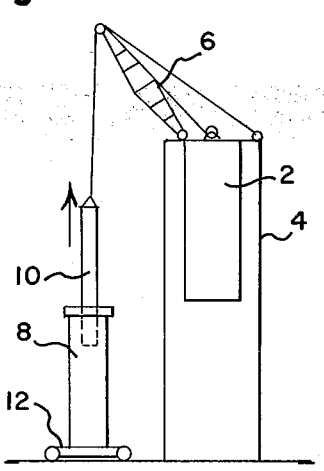

FIGS. 1A–1F show the general sequence of operation. Each of the figures shows a furnace 2 with a furnace support structure 4. On top of the furnace support structure 4 is a crane assembly 6. A vertical pipe quench 8 for quenching a metal pipe 10 is mounted on a mobile carriage 12. 1F 1A shows the pipe 10 being lowered into the vertical pipe quench 8 by the crane 6. FIG. 1B shows the pipe 10 inside the vertical pipe quench 8. The vertical pipe quench 8 is then moved under the furnace 2. FIG. 1C shows the pipe 10 raised into the furnace 2 by an elevator, where the pipe is heated to the correct temperature for quench hardening and held at that temperature for the proper length of time. Then, as shown in FIG. 1D the pipe 10 is lowered into the vertical pipe quench 8 and the quench fluid is applied to the pipe 10. FIG. 1E shows the quenched pipe 10 inside the vertical pipe quench 8 which is moved away from beneath the furnace 2. FIG. if shows the quenched pipe 10 being removed from the vertical pipe quench 8 by the crane 6. The cycle is then repeated.

Figure 2:
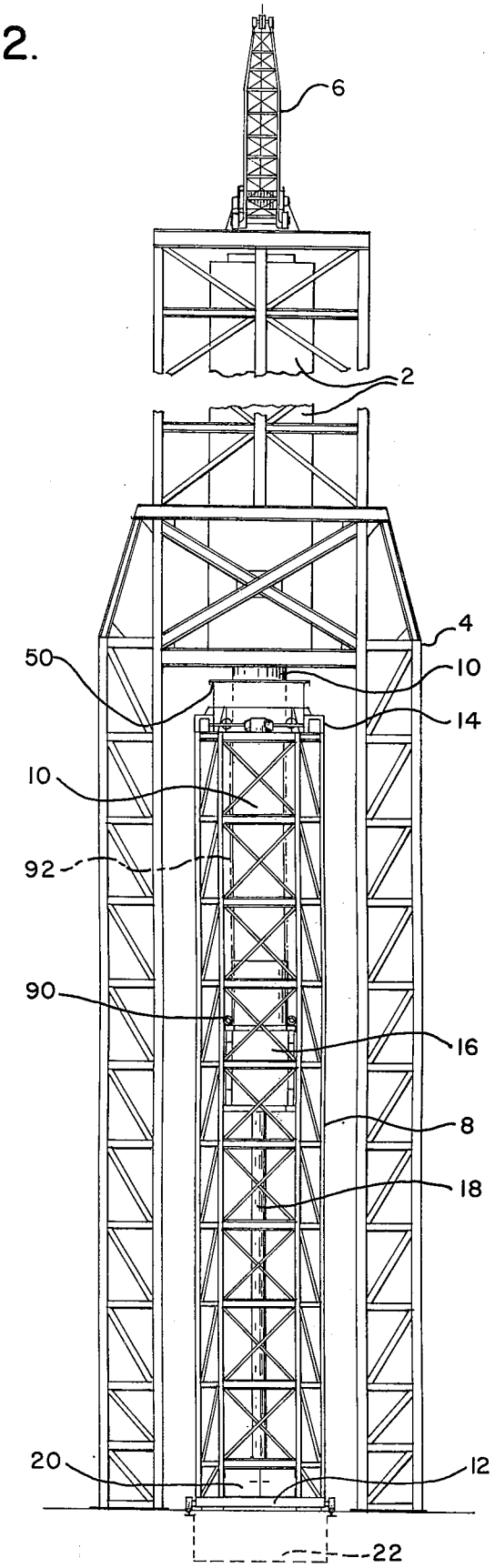
FIG. 2 is an elevational view of the vertical pipe quench structure and a portion of the furnace structure.

The remaining figures show a more detailed structure for the vertical pipe quench 8. Referring to FIG. 2, the crane 6 is shown on top of the furnace support structure 4 which supports the furnace 2. Pipe 10 is shown entering (or leaving) the furnace 2 and entering (or leaving) the vertical pipe quench 8 located immediately below the furnace 2. The lift machinery and platform 14 is for lifting and lowering the elevator 16 upon which the pipe 10 rests. A sectional support column 18 provides support for the vertical pipe quench 8. At the bottom of the vertical pipe quench 8 the high pressure and low pressure water pumps are located in the pump compartment 20. The vertical pipe quench 8 is mounted or rests on carriage 12. Below carriage 12 is a sump 22 for catching the quench fluid as it falls from the vertical pipe quench 8.

Figure 3:
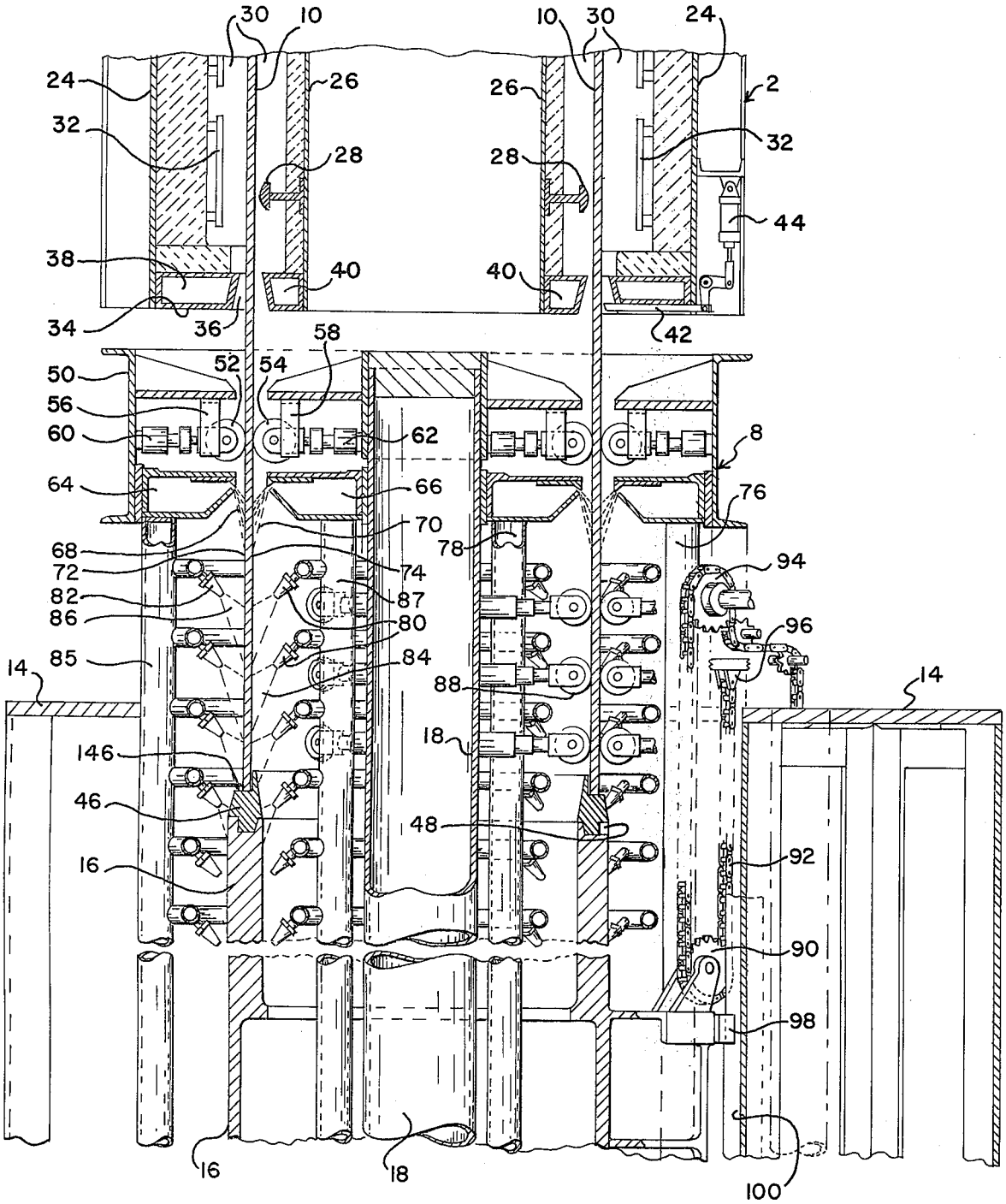
FIG. 3 is a fragmentary cross section of the furnace, vertical pipe quench and elevator taken generally on the line 3—3 of FIG. 5.

FIG. 3 shows a more detailed structure of the furnace 2 and vertical pipe quench 8. At the top of the figure the furnace shell 2 is shown. The furnace 2 has a cold wall 24 and a cold wall 26. Mounted on the cold wall 26 are pipe centering guides 28 to center the pipe 10 when it is inserted in the furnace 2. The furnace heating chamber 30 is heated by a suitable means which can be electrical heating elements 32. At the bottom 34 of the furnace 2 is located the furnace entrance or ring gap 36 which is designed to permit the pipe 10 to pass freely into the furnace 2. The furnace entrance is water cooled and chambers 38 and 40 are provided to receive circulating water. Also shown on the furnace 2 is a latching mechanism which comprises a latch bolt 42 which is coupled to a hydraulic cylinder means 44. The purpose of this latching assembly is to hold the furnace seal ring 46 against the entrance to the furnace. The seal ring 46 also supports the pipe 10 in the furnace.

Latch bolt 42 (there are eight) enters the eight latch bolt slots 48 (there are eight) which is slotted in the elevator 16. The vertical pipe quench 8 is positioned directly beneath the furnace 2. At the top of the vertical pipe quench 8 is an outer ring structure 50. There is an outer ring and an inner ring with each ring comprising a plurality of shaping rollers 52 and 54 respectively. These rollers are directly opposed and are positioned so as to receive the pipe 10. The rollers 52 and 54 are mounted on supports 56 and 58 respectively. Hydraulic cylinders 60 and 62 force the rollers 52 and 54 against the pipe 10. The shaping rollers 52 and 54 are followed by an outer quench curtain header 64 and an inner quench curtain header 66. Outer quench header 64 produces a conical quench curtain of fluid 68 with an imaginary apex downward along the longitudinal axis of the center of the vertical pipe quench 8. The inner quench header 66 produces a conical curtain of quench fluid 70 having an imaginary apex upward along the longitudinal axis. The two conical quench curtains 68 and 70 converge and form a pair of rings 72 and 74 of impingement on the surfaces of the pipe which are directly opposite each other. Manifold 76 provides the quench fluid to the high intensity outer quench curtain header 64 and manifold 78 provides the quench fluid to the high intensity inner quench curtain header 66. The high intensity quench curtain headers 64 and 66 are located as close as possible to the restraining and reshaping rollers 52 and 54. Directly beneath the high intensity quench curtain headers 64 and 66 are a plurality of inner and outer rings having a plurality of inner and outer nozzles 80 and 82 respectively which provide circular bands of sprays 84 and 86 against the pipe 10 to maintain the surface temperature established by the initial quench impingement 72 and 74. These spray nozzles 80 and 82 are supplied by manifolds 87 and 85 respectively. The rings of spray nozzles 80 and 82 are spaced along the longitudinal axis of the vertical pipe quench 8. Dispersed between the rings of spray nozzles along the longitudinal axis of the vertical pipe quench 8 are internal guide rollers 88 which guide the pipe 10 as it continuously moves through the vertical pipe quench 8 on elevator 16. Attached to the elevator 16 is a sprocket 90 around which is a lifting chain 92 which extends up to sprocket 94 which is driven by the lift machinery 14. The lift chain 92 is dead-ended and anchored on the quench structure shown in FIG. 2 at 96. The quench elevator 16 has elevator guides 98 which engage elevator guide rails 100.

Figure 4:
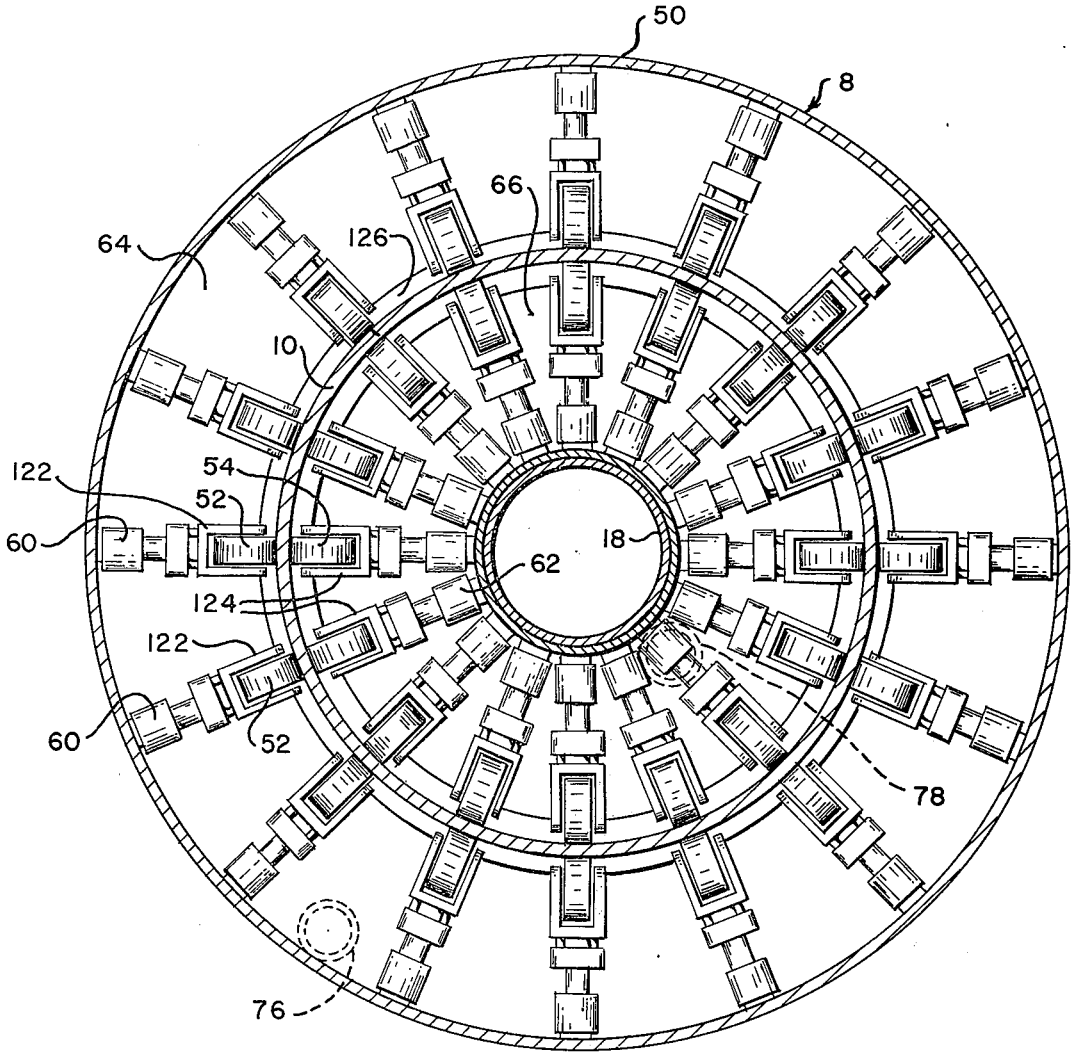
FIG. 4 is a cross sectional view taken on the line 4—4 of FIG. 3.

Referring to FIG. 4 which is a cross section showing the rings of outer and inner reshaping rollers 52 and 54, the rollers 52 and 54 are supported by yokes 122 and 124 respectively. Hydraulic cylinders 60 and 62 force the rollers 52 and 54 against the pipe 10. The rollers 52 and 54 define a ring gap 126 through which the pipe 10 passes while it is being shaped into a round configuration and the round configuration is maintained and restrained while the pipe 10 is quenched.

Figure 5:
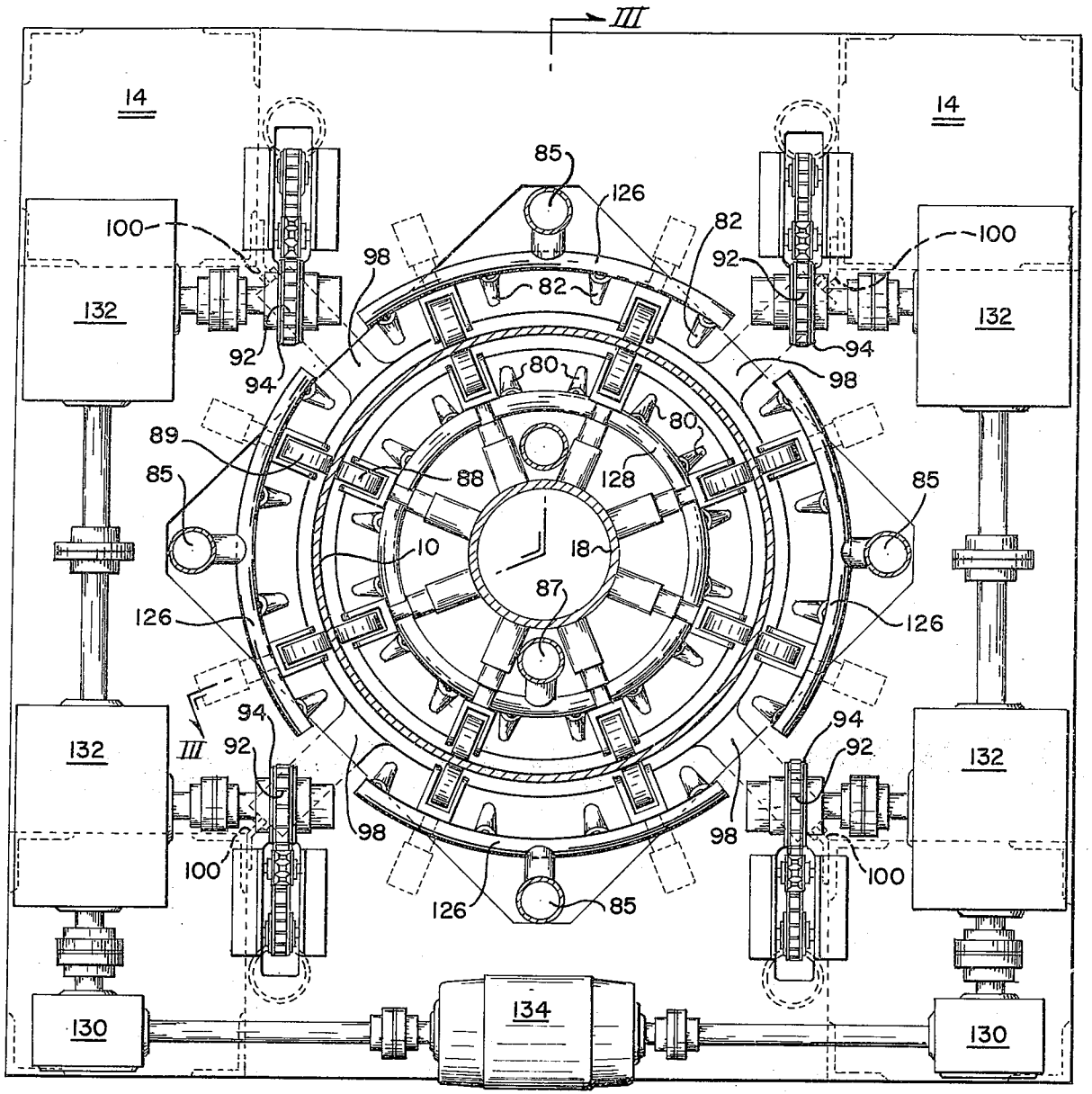
FIG. 5 is a cross sectional view partly in section and partly in elevation taken on the line 5—5 of FIG. 3.

FIG. 5 shows a cross section of the vertical pipe quench 8 showing details of the rings which provide additional bands of quench fluid which follow the high intensity quench curtain. Each of the outer rings 126 and the inner rings 128 have a plurality of spray nozzles 82 and 80 respectively. Spaced at various points between the inner and outer spray nozzles 80 and 82 are internal and external guide rollers 88 and 89 which engage the pipe 10. The outer and inner rings are fed by the low intensity manifolds 85 and 87. The platform 14 is shown with the lifting machinery which includes speed reducers 132, right angle drive units 130, and the driven sprocket 94 with lifting chain 92. The drive sprockets 94 are all driven by the elevator drive motor 134.

Figure 6:
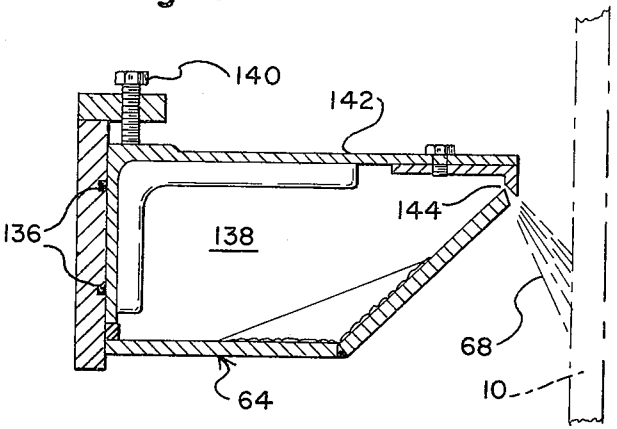
FIG. 6 is a detailed cross sectional view of a curtain header shown in FIG. 3.

FIG. 6 is a detailed cross section of the outer quench curtain header 64 which has O-ring seals 136, and a quench compartment 138. Adjustable screws 140 position the adjusting plate 142 to create the gap 144 which generates the conical water curtain 68 (or 70) that strikes the pipe 10.

Figure 7:
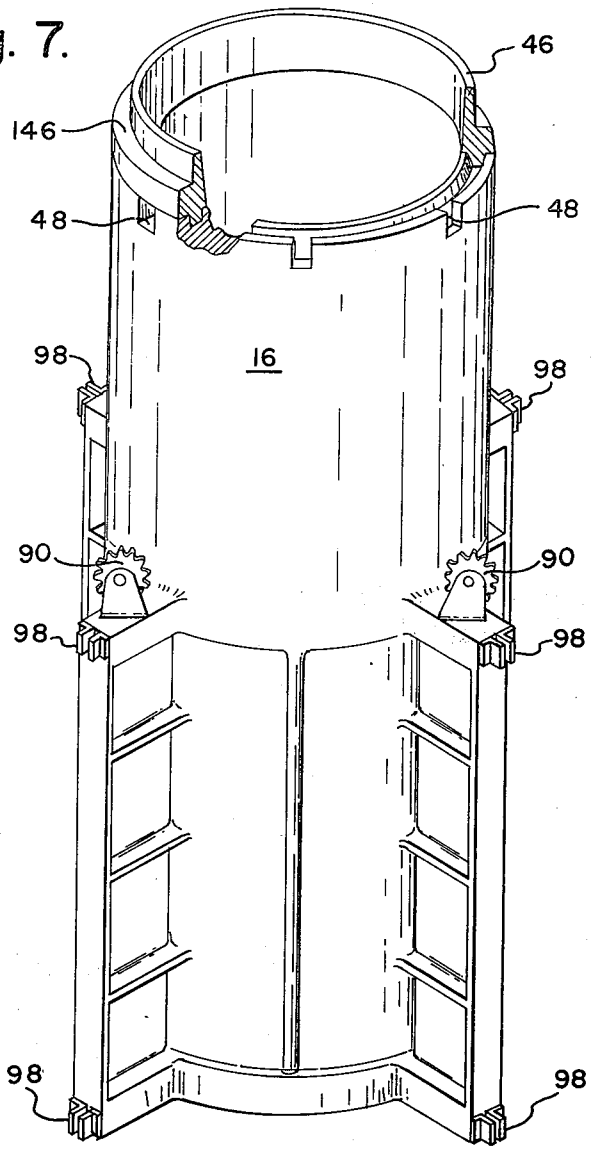
FIG. 7 is an isometric view partly in section of the elevator shown in FIG. 3.

FIG. 7 shows the details of the elevator 16 showing the elevator guides 98 (which engage rails 100), sprockets 90 and the latch bolt slots 48 which receive the latch bolt 42 (FIG. 3). Resting on top of the elevator 16 is the seal ring 46 which supports the pipe 10 which rests upon the flange 146 of the seal ring 46. The seal ring 46 is removable and also can be replaced as an expendable item after it passes through the quench. It can be made of some suitable material such as a refractory.

B. The Operation And Method

The sequence of the operations are shown typically in FIGS. 1A–1F. The pipe 10 is aligned so that its longitudinal axis is vertical and rests upon the seal ring flange 146. The vertical pipe quench is moved into position under the furnace 2. The elevator 16 is raised carrying the pipe 10 into the furnace 2. The hydraulic latching cylinder 44 is activated and the latch bolt 42 goes through the latch bolt slot 48 and holds the seal ring which has two functions. It holds the pipe 10 in the furnace 2 and seals the opening 30 of the furnace 2. When the furnace 2 has heated the pipe 10 to the proper quench hardening temperature and maintained to for the proper length of time, the quench unit 8 is returned on a track (not shown) directly under the furnace 2. It is understood that the vertical pipe quench 8 may serve several furnaces. After the elevator is raised against the seal ring, the latch bolts 42 then are disengaged from the slots 48 and the elevator 16 is continuously lowered at a controlled suitable rate of speed by the drive 134, reducers 132, sprocket and chain 92 and 94, and sprocket 90. Inasmuch as the pipe will not have a truly round configuration the shaping rollers 52 and 54 press against the pipe 10 and shape the pipe into a round configuration and maintain that round configuration and restrain the pipe as the pipe 10 is lowered to the adjacent high intensity quench headers 64 and 66 which create a high velocity quench curtain conical in shape which impinge the pipe 10 forming a pair of impingement rings 74 and 72 directly opposite on the inner and outer surfaces of the pipe 10. The quench curtains 68 and 70 strike the pipe 10 at an angle which avoids any splash back that could cause pre-cooling of the pipe. The surface temperature of the pipe 10 is set by the initial impingement at 72 and 74. This temperature is maintained by the application of additional bands of quench fluid delivered from outer and inner rings of nozzles 82 and 80. Inner and outer guide rollers 88 and 89 position the pipe 10 and maintain its alignment with respect to the nozzles as the pipe is continuously passed through the vertical pipe quench 8. A sump 22 collects the quench fluid which can be cooled and recirculated as desired.

When the shaping rollers 52 and 54 are retracted they have their faces a sufficient space apart to allow the seal 46 and the pipe 10 to pass between them. When extended the roll faces meet so that when the pipe passes between them the springs (not shown) are compressed an amount sufficient to generate the required shaping force. An equal force is applied on both the inner and outer surfaces of the pipe when the pipe is round. When pipe which is not round enters the reshaping rollers 52 and 54, those portions of the pipe lying inside their correct circular position will compress the springs in that area a greater amount than those in adjacent areas which will generate a greater force which will push the pipe outward. Adjacent areas around the pipe will lie outside the correct circular position. There the outer rollers will be compressed an additional amount and additional forces will be generated at those points. The forces thus generated will exert a bending movement on the hot pipe forcing it into a round configuration.

I claim:

1. An apparatus for vertically quenching a hot metal pipe comprising:

a. a first means shaping the hot pipe into a round configuration and restraining the pipe in the round configuration;

b. a second means applying high intensity curtains of quench fluid to the inside surface of the pipe and to the outside surface of the pipe, the quench curtains impinge the inner and outer surfaces in the form of rings; and c. a third means supporting the pipe and continuously moving it to and through the first means then through the second means in a substantially vertical path in the direction of the longitudinal axis of the pipe.

2. An apparatus for vertically quenching a hot metal pipe comprising:

a. a first means shaping the hot pipe into a round configuration and restraining the pipe in the round configuration;

b. a second means simultaneously applying high intensity curtains of quench fluid to the inside surface of the pipe and to the outside surface of the pipe, the quench curtains impinge the inner and outer surfaces in the form of rings which are opposite each other; and c. a third means supporting the pipe and continuously moving it to and through the first means then through the second means in a substantially vertical path in the direction of the longitudinal axis of the pipe.

3. Apparaus as recited in claim 2 wherein the second means includes:

a. an inner header for use inside the pipe and producing an inner high velocity conical curtain of quench fluid; and b. an outer header for use outside the pipe and producing an outer high velocity conical curtain of quench fluid, the two cones converge to form a ring between the outer and inner headers and the two cones of quench fluid are directed so that the curtains strike the surfaces of the pipe at a downward angle of impingement less than 90°.

4. Apparatus as recited in claim 3 wherein the first means includes an inner ring of a plurality of rollers for use inside the pipe and at a position above the second means applying the high intensity curtains; and an outer ring of a plurality of rollers for use outside the pipe, and which are opposite the rollers on the inner ring, each of the rollers on both rings press against the hot pipe whereby the rings of rollers engage the hot pipe and shape it before it is quenched and restrain it while the pipe is being quenched.

5. Apparatus as recited in claim 4 including a fourth means located below the second means and applying additional quench fluid to the inside surface and outside surface of the pipe.

6. Apparatus as recited in claim 5 wherein the third means includes an elevator upon which the pipe rests.

7. Apparatus as recited in claim 6 including a plurality of rings of guide rollers which are positioned for use inside and outside the pipe and are positioned below the second means.

8. Apparatus as recited in claim 7 wherein the fourth means applying a quench fluid includes a plurality of pairs of corresponding inner and outer rings having a plurality of spray nozzles with the inner rings located for use inside the pipe and the outer rings located for use outside the pipe.

9. Apparatus for vertically heating and vertically quench hardening a metal pipe comprising:

a. a furnace;

b. an elevator means for moving the pipe vertically into and out of the furnace with the longitudinal axis of the pipe vertical;

c. a means for shaping the hot pipe into round configuration as it leaves the furnace, the means located directly beneath the furnace; and d. a quench means applying a high intensity quench fluid to the inside and outside surface of the pipe after it has been shaped, the quench means is located below the means for shaping the heated metal pipe.

10. A method of vertically quenching a hot metal pipe comprising:

a. supporting the pipe with its lognitudinal axis in the vertical position;

b. then moving the pipe in a vertical direction;

c. then shaping the hot metal pipe into a round configuration as it is moving in the vertical direction; and d. then applying high intensity curtains of quench fluid to the inside surface and outside surface of the pipe which form opposite rings of impingement as the pipe is moving and is applied so as to avoid pre-cooling by any splash back as the pipe is moving.

11. Method as recited in claim 10 including an additional step of applying a quench fluid to the inner and outer surfaces of the pipe after the initial impingement of the quench fluid.

12. A method of vertically heating and vertically quench hardening a metal pipe which comprises:

a. moving the pipe upward with the longitudinal axis vertical into a furnace;

b. then heating the pipe;

c. then lowering the pipe out of the furnace;

d. then shaping the pipe into a round configuration as it leaves the furnace; and e. then quenching the pipe with curtains of quench fluid applied to the inside and outside surfaces of the pipe.

* * * * *